US006331126B1

(12) United States Patent
Wagner

(10) Patent No.: US 6,331,126 B1
(45) Date of Patent: Dec. 18, 2001

(54) HIGH SPEED MODULAR JACK

(75) Inventor: Justin S. Wagner, York, PA (US)

(73) Assignee: Sentinel Holding, Inc., York, PA (US)

( * ) Notice: Subject to any disclaimer, the term of this patent is extended or adjusted under 35 U.S.C. 154(b) by 0 days.

(21) Appl. No.: 09/656,893

(22) Filed: Sep. 7, 2000

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS

| | | | |
|---|---|---|---|
| 5,096,442 | 3/1992 | Arnett et al. | 439/676 |
| 5,186,647 | 2/1993 | Denkmann et al. | 439/395 |
| 5,310,363 | 5/1994 | Brownell et al. | 439/676 |
| 5,362,257 | 11/1994 | Neal et al. | 439/676 |
| 5,403,200 | 4/1995 | Chen | 439/404 |
| 5,432,484 | 7/1995 | Klas et al. | 333/1 |
| 5,547,405 | 8/1996 | Pinney et al. | 439/894 |
| 5,586,914 | 12/1996 | Foster, Jr. et al. | 439/676 |
| 5,599,209 | 2/1997 | Belopolsky | 439/676 |
| 5,626,497 | 5/1997 | Bouchan et al. | 439/676 |
| 5,639,266 | 6/1997 | Patel | 439/676 |
| 5,647,770 | 7/1997 | Belopolsky | 439/676 |
| 5,674,093 | 10/1997 | Vaden | 439/676 |
| 5,697,817 | 12/1997 | Bouchan et al. | 439/676 |
| 5,759,070 | 6/1998 | Belopolsky | 439/676 |
| 5,779,503 | 7/1998 | Tremblay et al. | 439/676 |
| 5,791,942 | 8/1998 | Patel | 439/637 |
| 5,911,602 | 6/1999 | Vaden | 439/676 |
| 5,921,818 | 7/1999 | Larsen et al. | 439/676 |
| 5,938,479 | 8/1999 | Paulson et al. | 439/676 |
| 5,941,734 | 8/1999 | Ikeda et al. | 439/676 |
| 5,971,813 | 10/1999 | Kunz et al. | 439/676 |
| 5,975,960 | 11/1999 | Fogg et al. | 439/676 |
| 5,997,358 | 12/1999 | Adriaenssens et al. | 439/676 |
| 6,017,247 | 1/2000 | Gwiazowski | 439/676 |
| 6,066,005 | 5/2000 | Belopolsky | 439/676 |
| 6,102,730 * | 8/2000 | Kjeldahl et al. | 439/676 |
| 6,116,964 * | 9/2000 | Goodrich et al. | 439/676 |
| 6,120,329 | 9/2000 | Steinman | 439/676 |
| 6,186,836 * | 2/2001 | Ezawa et al. | 439/676 |
| 6,196,880 * | 3/2001 | Goodrich et al. | 439/676 |

OTHER PUBLICATIONS

Eight figures illustrating a conventional modular jack referred to in specification. This jack was on sale Sep. 7, 2000.

* cited by examiner

*Primary Examiner*—Khiem Nguyen
*Assistant Examiner*—Hae Moon Hyeon
(74) *Attorney, Agent, or Firm*—Thomas Hooker, P.C.

(57) ABSTRACT

A high speed lock cross talk modular jack for mating with a plug mounted on the end of a data transmission cable having four pairs of twisted conductors includes wire contacts having cantilever ends extending into a plug recess and contact pins extending below the plug body. Intermediate portions of the wire contacts extending from the cantilever ends to the pins are spread and angled outwardly and the intermediate portions of the center wire contacts cross over each other to reverse the positions of the pins for these contacts.

24 Claims, 4 Drawing Sheets

HIGH SPEED MODULAR JACK

FIELD OF THE INVENTION

The invention relates to high speed modular jacks of the type mounted on circuit components for mating with plugs on the ends of multi-conductor cables used for transmitting signals between computers.

DESCRIPTION OF THE PRIOR ART

Modular jacks for forming electrical connections between circuit members and plugs mounted on the ends of multi-conductor data-transmission cables are well known. The cables conventionally have eight conductors arranged in four twisted conductor pairs. The jacks and plugs each have eight contacts to form connections between the eight conductors in the cable and the circuit member.

The jacks include a molded plastic body defining a plug recess for receiving a plug mounted on the end of a data transmission cable. Cantilever ends of wire contacts mounted in the body extend into and across the recess to form electrical connections with the contacts on a complimentary plug. The wire contacts run from the recess to pins which extend downwardly from the bottom of the jack. The pins are positioned in preformed holes in the circuit board and are soldered to conductive traces on the circuit board.

The cantilever ends of the wire contacts are spaced across the recess in the block and extend from the recess to the pins in side-by-side parallel relationship, without crossing each other. The pins are spaced across the jack in the same sequence as the contacts are spaced across the recess. The pins are arranged in two rows of pins extending across the body with alternate pins in different rows.

The industry standard for modular jacks requires that the wire pairs in twisted wire data transmission cables be connected to particular cantilever ends in the plug recess. These ends are spaced across the recess in numerical positions 1 through 8 with the cantilever end 1 adjacent one end of the recess and cantilever end 8 adjacent the opposite end of the recess. The industry standard requires that twisted wires in a first pair of twisted wires must be connected to cantilever ends 1 and 2. A second pair of twisted wires must be connected to cantilever ends 3 and 6. A third pair of twisted wires must be connected to cantilever ends 4 and 5 and a fourth pair of twisted wires must be connected to cantilever ends 7 and 8. Modern high speed computing requires rapid transmission of signals along cables, through the plugs and jacks and to computer circuitry with low cross talk between adjacent circuit paths. EIA/TIA Category 5 standards govern permissible near end cross talk generated by modular jacks used for transmitting signals from 1 to 100 MHz. More stringent Category 6 standards govern near end cross talk in modular jack transmitting signals up to 250 MHz. Conventional modular jacks have difficulty meeting Category 5 cross talk standards and cannot meet Category 6 cross talk standards.

Cross talk in conventional signal transmission jacks is believed generated by intermediate portions of the wire contacts which extend along the rear wall of the jack from the cantilever contacts to solder pins at the bottom of the jack. In this type of jack, it is particularly difficult to reduce cross talk between separated contacts 3 and 6 and adjacent contacts which are connected to other signal pairs.

Jacks which generate cross talk at high frequency transmission rates may use specialized compensation systems to compensate for inherent cross talk. It is also possible to incorporate special circuitry in the circuit board supporting the jack to compensate for cross talk generated by the jack. Cross talk compensation systems are expensive, complicate manufacture and are not always effective over a desired range of transmission frequencies.

Thus, there is a need for an improved jack for transmitting high speed signals with very low near end cross talk. The jack should space the wire conductors extending from the plug recess to the pins to reduce cross talk and should eliminate the need for a specialized cross talk compensation system in the jack. The jack should meet Category 5 near end cross talk standards and should, when mounted on a circuit board with the circuit board traces including a cross talk compensation system, meet Category 6 cross talk standards.

SUMMARY OF THE INVENTION

The invention is an improved modular jack for high speed data transmission, typically for establishing electrical connections with an end plug on a data cable having four twisted pairs of conductors. The jack generates very little near end cross talk and meets Category 5 near end cross talk standards. The jack may be mounted on a circuit board having conductive traces arranged to compensate for the low level of cross talk generated by the jack. The jack and board are believed to meet Category 6 near end cross talk standards. The jack is preferably mated with a plug generating low cross talk to form a connection system with low cross talk joining an eight conductor cable to electronic circuitry, typically computer circuitry.

The jack includes wire contacts with conventional cantilever ends extending into a plug recess in the jack for engaging and forming electrical connections with contacts in an inserted plug. The wire contacts intermediate portions run from the cantilever ends to pins projecting below the bottom of the jack. The pins are arraigned in two rows of pins. An end pin in each row of pins is separated from the remaining three pins in the row with the separated pins positioned on opposite ends of the rows. The intermediate portions of the center two wire contacts in the jack cross over each other at the back of the jack so that the pins for these contacts are arranged out of normal sequence across the jack. The intermediate portions do not parallel each other.

In a conventional modular jack, the cantilever ends of the wire contacts are arranged 1,2,3,4,5,6,7,8 across the plug recess and the corresponding pins are arranged in spaced staggered rows across the jack in the same 1,2,3,4,5,6,7,8 sequence with the even pins in one row and the odd pins in the other row.

In the modular jack of the present invention, crossover of the intermediate portions of the center two wire contacts reverses the positions of the center two pins so that the pins are arranged across the jack in spaced, staggered rows in 1,2,3,5,4,6,7,8 sequence.

The positions of the jack pins and the arrangement of the intermediate portions of the wire contacts reduce cross talk generated by the jack and permit the jack to meet Category 5 standards.

In one test, a conventional jack of the type described with pins in the same sequence as the cantilever ends and parallel intermediate portions generated −38 dB of cross talk. In the same test using the jack of the present invention, the cross talk was reduced to −44 dB.

Other objects and features of the invention will become apparent as the description proceeds, especially when taken in conjunction with the accompanying drawings illustrating the invention, of which there are four sheets and one embodiment.

DESCRIPTION OF THE PREFERRED EMBODIMENT

Figure 1:
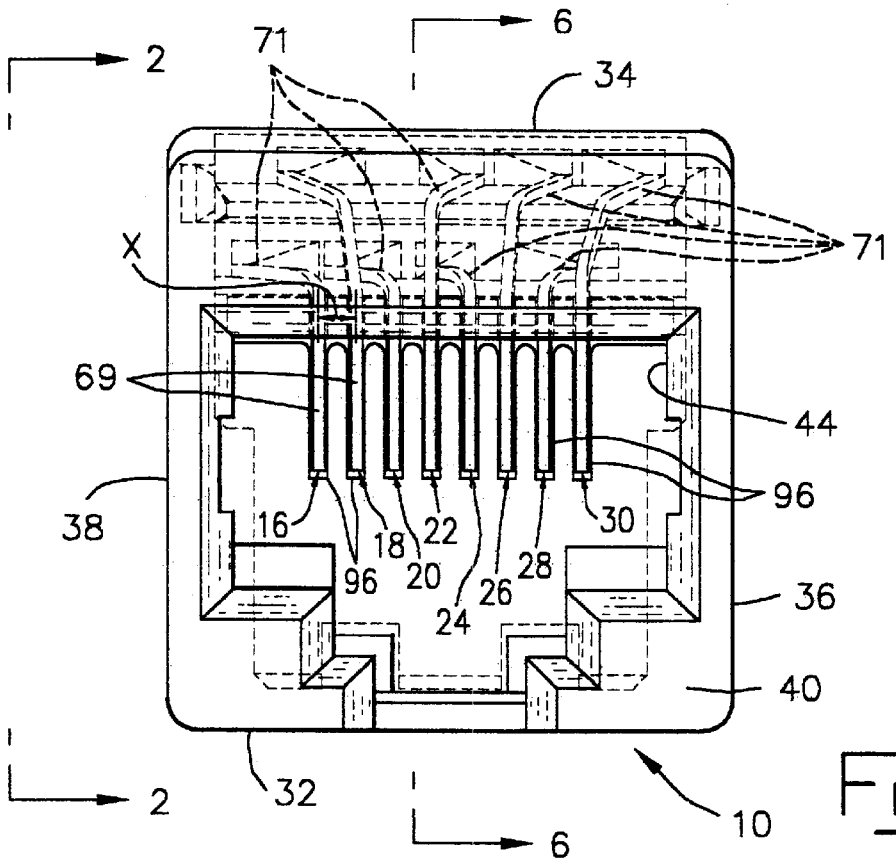
FIG. 1 is a top view of a modular jack according to the invention.
Figure 2:
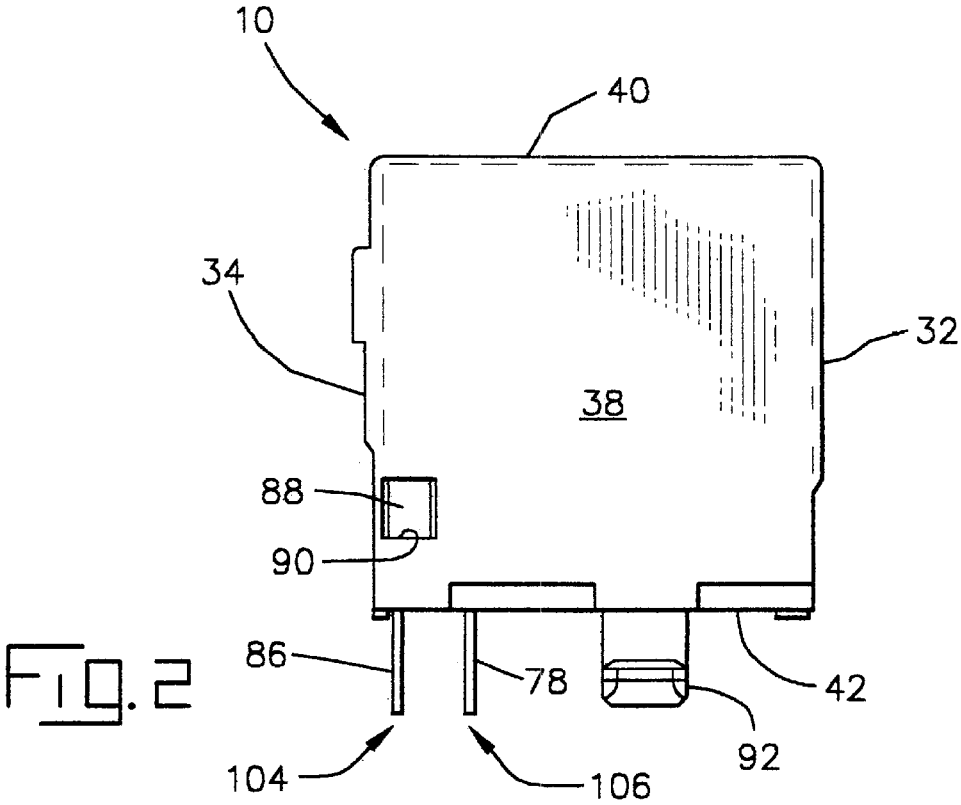
FIG. 2 is a side view of the modular jack taken along line 2—2 of FIG. 1.

Modular jack 10 includes an insert member 12 and a shell 14 surrounding the member. The jack carries eight shaped wire contacts 16–30 for forming electrical connections between eight corresponding contacts of a modular plug inserted into the jack and conductive traces on a circuit board supporting the jack. Pins on the ends of the wire contacts are soldered to conductive traces on the circuit board. Member 12 and shell 14 are molded from a dielectric material, which may be a polyester thermoplastic, although other materials may be used.

Jack 10 is generally rectangular or block shaped and includes front wall 32, rear wall 34, opposed sidewalls 36 and 38, open top wall 40 and bottom wall 42. Plug recess 44 extends into jack 10 through top wall 40 for receiving a modular plug and forming electrical connections between contacts carried by the plug and wire contacts 16–30.

Insert member 12 includes a flat base 46 which fits into the bottom of shell 14 to form bottom wall 42. Contact support member 48 extends above the rear end of base 46 and forms part of rear wall 34. Member 48 extends across the jack, between the sides of base 46. The front side of the support member 48 forms part of the rear wall of recess 44. A first row 49 of contact alignment passages 50, 52, 54 and 56 extends across member 48 adjacent back wall 34. A second row 57 of contact alignment passage 58, 60, 62 and 64 extends across the member 48 between the first row 49 and plug recess 44. Each of the contact alignment passages 50–64 extends vertically along member 48 and includes a large rectangular opening at the top of the member 48, inwardly sloped sidewalls and a small lower opening at the bottom of the insert member 12. The lower ends of the wire contacts have sliding fits in the lower ends of the passages so that the lower ends of the wire contacts are held in desired locations on base 46 and form solder pins. The wire contacts are inserted freely into the passages and are guided to the desired locations by the angled passage walls. The passages orient the pin ends of the wire contacts in the pattern illustrated in FIG. 3 for mounting on the circuit board shown in FIG. 4.

Figure 7:
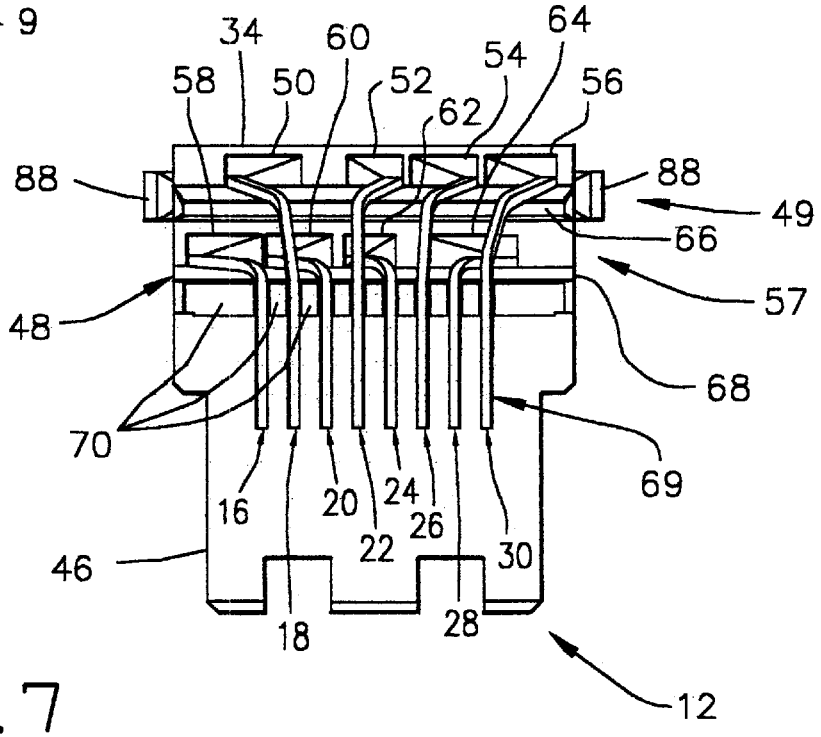
FIG. 7 is a top view of the insert member and wire contacts.
Figure 9:
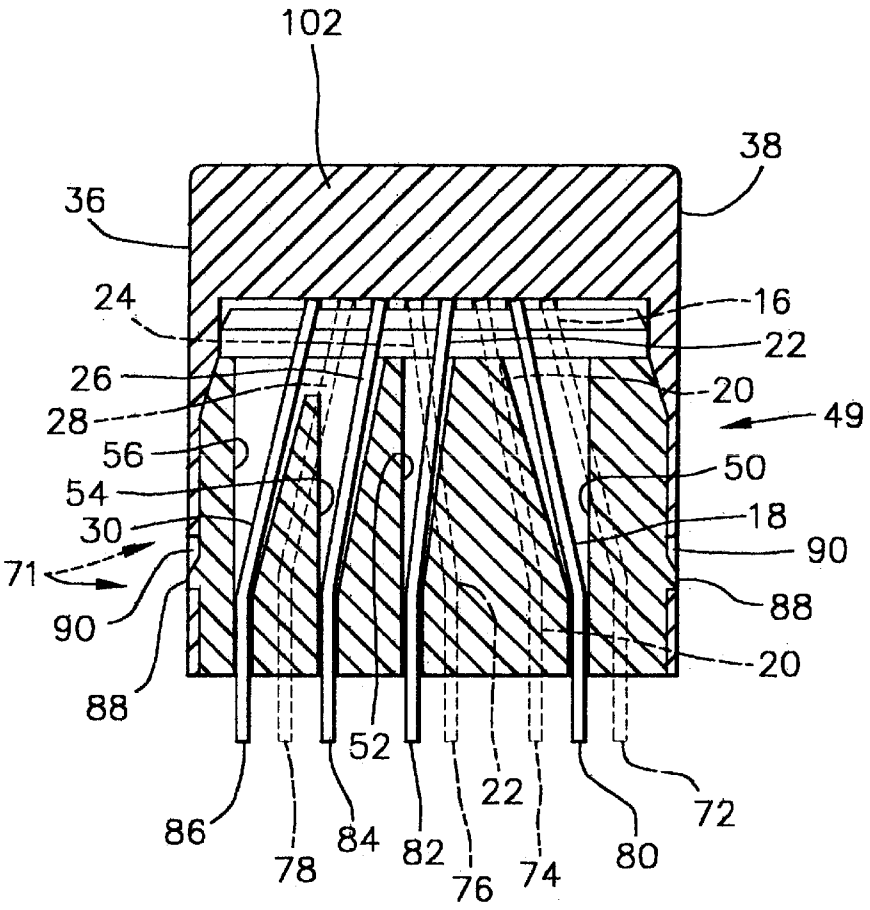
FIGS. 8 and 9 are sectional views taken along lines 8—8 and 9—9 of FIG. 5, respectively.
Figure 8:
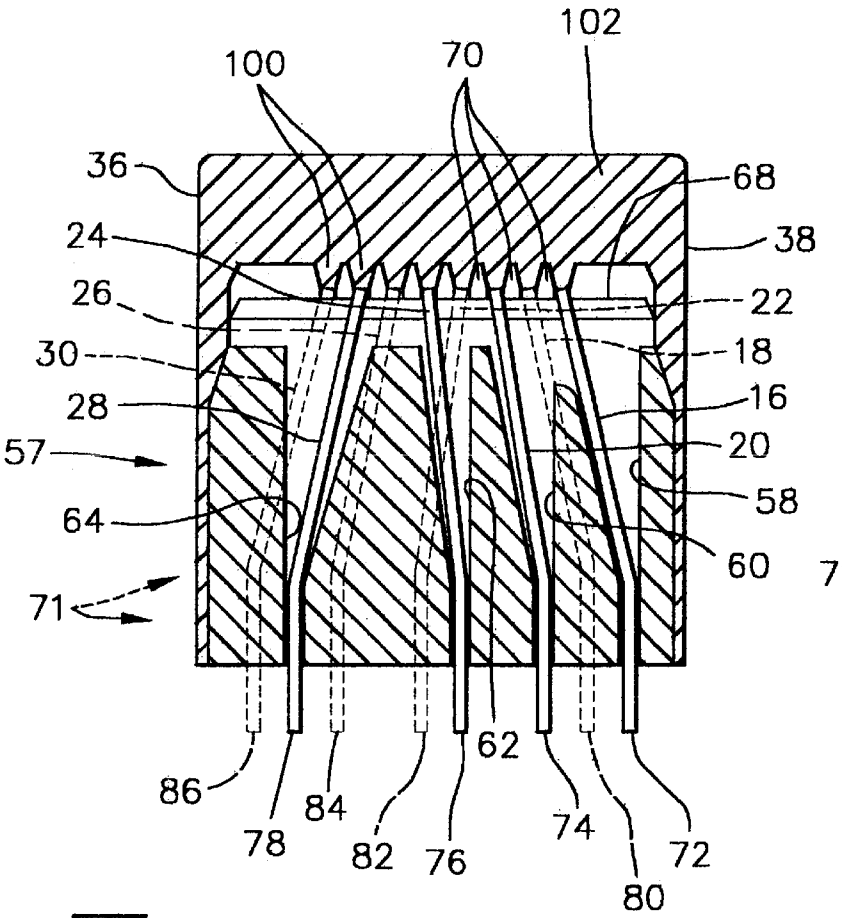

As illustrated in FIGS. 7 and 8, in row 57 passage 64 leads wire contact 28 from the top of the support member 48 toward sidewall 36 and passages 58, 60 and 62 lead wire contacts 16, 20 and 24 in the opposite direction, toward sidewall 38. As shown in FIGS. 7 and 9, in row 49 passages 52, 55 and 56 lead wire contacts 22, 26 and 30 toward sidewall 36 and passage 50 leads wire contact 18 in the opposite direction toward sidewall 38.

Support member 48 includes a first contact positioning rib 66 extending along the length of the member 48 between the two rows of contact alignment passages and projecting above the passages. A second contact positioning rib 68 extends along the length of the support member 48 between the inner row 57 of passages and recess 44. Contact alignment fingers 70 are spaced along the top of rib 68.

Wire contacts 16–30 are mounted on insert member 12 as shown in FIG. 7 with the lower ends of the wire contacts extending through the openings at the bottoms of the alignment passages to form contact pins. Each wire contact includes an intermediate portion 71, shown in FIG. 1, extending from a pin on the bottom of the jack to the top of the support member 48. Each wire contact is bent around the top of the support member 48, fitted in a space between a pair of fingers 70 and then extends downwardly into plug recess 44. The inner ends of the wire contacts angle into the recess and form cantilever contacts or ends 69. Insertion of a plug into recess 44 bends the cantilever contacts toward the support member 48 to form electrical connections with contacts carried by the plug.

Wire contact 16 is inserted in alignment passage 58 to form pin 72 projecting below base 46. Contact 16 extends upwardly from passage 58, is bent around rib 68, extends between two fingers 70 and is angled down from the rib 68 to form a cantilever contact 69.

Wire contacts 20, 24 and 28 are inserted into remaining alignment passages 60, 62 and 64 in row 57 to form pins 74, 76 and 78 extending below base 46. Contacts 20, 24 and 28 extend upwardly from their respective passages, are bent around rib 68 and extend between two fingers 70 to form cantilever contacts 69 angling down from the top of support member 48. Each contact is located in position on the rib 68 by a pair of adjacent fingers 70.

Contacts 18, 22, 26 and 30 are likewise extended into passages 50, 52, 54 and 56 in row 49 to form pins 80, 82, 84 and 86, respectively, extending below base 46. The upper portions of these contacts are bent around ribs 66 and 68, positioned between two fingers 70 on rib 68 and extend into recess 44. The eight cantilever contacts 69 are held on rib 68 in industry standard center-to-center spacing X of 0.040 inches for engaging corresponding contacts carried by a plug inserted into recess 44. Spacing X is shown in FIG. 1.

Latches 88 extend outwardly from the sides of support member 48 and engage openings or windows 90 formed on the opposite sides of shell 14 to secure the shell 14 to the insert member 12. See FIG. 9.

Shell 14 includes a pair of circuit board latches 92 extending downwardly from opposite sides of the shell for securing jack 10 on a circuit board.

Figure 6:
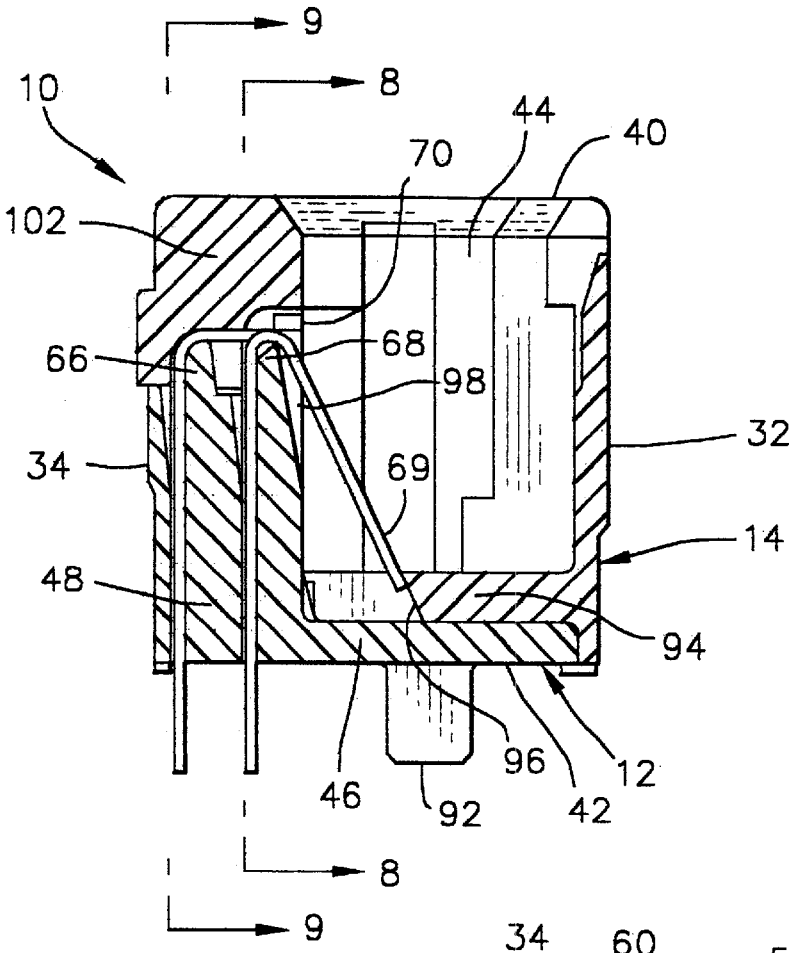
FIG. 6 is a sectional view taken along line 6—6 of FIG. 1.

Shell 14 includes floor 94 forming the bottom of recess 44 and extending across the recess 44 from the front of the jack to support member 48. Slots 96 are formed in the forward end of floor 94 adjacent the support member 48 and are spaced along the support member 48 to receive the ends of the cantilever contacts 69 extending into recess 44. The wire contacts are biased outwardly into the recess 44 so that the lower ends of the contacts engage the ends of the slots as shown in FIG. 6. Corresponding contact slots 98 are formed across the top of the support member 48 adjacent the recess 44 and facilitate orienting the cantilever contacts in the jack. Fingers 70 and slots 96 and 98 assure that the cantilever contacts extend into recess 44 for engagement with contacts on a plug inserted into the recess.

Insert member 12 with wire contacts mounted in the member 12 as described, is inserted into shell 14 by extending the support member 48 into the shell between the rear wall and floor 94 with the cantilever ends of the wire contacts each positioned in a slot 96. With the insert fully seated in the shell, base 46 is flush against floor 94 and windows 90 have snapped over latches 88 to secure the insert member 12 and shell together, as illustrated in FIG. 9. The member 12 and shell form a jack body.

A row of fingers 100 extend downwardly from shell top wall 102 above rib 68. Fingers 100 cooperate with fingers 70 to assure that the wire contacts extending across the ribs 66 and 68 are held in proper position. Top wall 102 is spaced from the top and rear side of positioning rib 66 a distance slightly greater than the thickness of the wire contacts to assure the contacts are held closely against the rib. See FIG. 6.

FIG. 8 illustrates the contact alignment passages 58, 60, 62 and 64 in the second passage row 57 and the intermediate portions 71 of wire contacts 16, 20, 24 and 28 extending through the passages. The intermediate portions of the remaining wire contacts extending through the first row of passages 49 are shown in dashed lines. The intermediate portions 71 of wire contacts 16, 18 and 20, and 26, 28, and 30 led from the top of the support member 48 down to the terminal pins are angled and spread apart across the width and depth of the jack as illustrated in FIGS. 7–9. The intermediate portions of the center two contacts 22 and 24 cross each other at the center of the support member 48 and are angled and spread.

In row 57, the intermediate portions of the three wire contacts 16, 20 and 24 adjacent jack side 38 are all angled from the top of the support member 48 toward side 38 so that pins 72, 74 and 76 are located nearer side 38 than the cantilever contacts 69 on the other ends of the wire contacts. The pins are spaced apart 0.100 inches, greater than the 0.040 inch spacing of the cantilever contacts. The intermediate portion of contact 28 is bent toward jack side 36 to locate pin 78 adjacent side 36 and space pin 78 a distance of 0.200 inches from adjacent pin 76 in row 57, twice the spacing between the remaining pins in the row.

Likewise, in row 49 the intermediate portions of wire contacts 22, 26 and 30 are spread and angled toward jack sidewall 36 to form pins 82, 84 and 86 spaced apart by 0.100 inches. The intermediate portion of wire contact 18 is bent towards jack sidewall 38 to form pin 80 which is adjacent wall 38 and spaced from adjacent pin 82 by 0.200 inches. FIGS. 7 and 9 illustrate the non-parallel spacing of the intermediate portions along the back of support member 48.

The intermediate portions of the center two wire contacts 22 and 24 are positioned in passages 52 and 62 in rows 49 and 57, and form pins 82 and 76 respectively. Pins 76 and 82 are spaced further apart between the jack sidewalls than the wire contacts 22 and 24 at the top of the support member 48.

Figure 3:
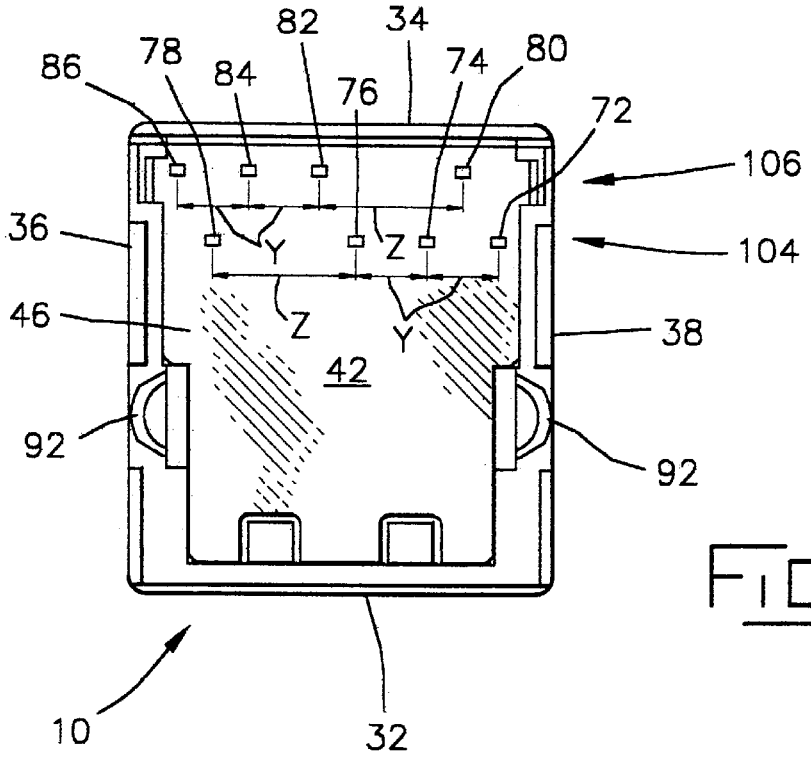
FIG. 3 is a bottom view of the modular jack.

The arrangement of the pins extending below the bottom of jack 10 is shown in FIG. 3. The pins are arranged in two spaced staggered rows 104 and 106 extending across the rear portion of the modular jack. Outer row 106 is located between inner row 104 and rear wall 34. The outer row 106 of pins includes single end pin 80 adjacent sidewall 38 and three equally spaced apart or adjacent pins 82, 84 and 86 near sidewall 36. The inner row 104 of pins includes a single end pin 78 near sidewall 36 and three equally spaced apart or adjacent pins 76, 74 and 72 near sidewall 38. Adjacent pins 72, 74 and 74, 76 in row 104 and 82, 84 and 84, 86 in row 106 are spaced apart a distance Y of 0.100 inches. The spacing Z between separated pins 76, 78 in row 104 and pins 80 and 82 in row 106, is twice the adjacent pin spacing, or 0.200 inches. The spacing between the two rows is 0.100 inches. The spacing between the pins measured in a direction along the rows is 0.050 inches from pin 72 to pin 80; 0.050 inches from pin 80 to pin 74; 0.100 inches from pin 74 to pin 76; 0.050 inches from pin 76 to pin 82; 0.100 inches from pin 82 to pin 84; 0.050 inches from pin 84 to pin 78; and 0.050 inches from pin 78 to pin 86.

As illustrated in FIG. 3, adjacent pins 82 and 84 in row 106 are located between end pin 78 and pin 76 in row 104. Also, the two adjacent pins 74 and 76 in row 104 are located between end pin 80 and adjacent pin 82 in row 106.

Figure 4:
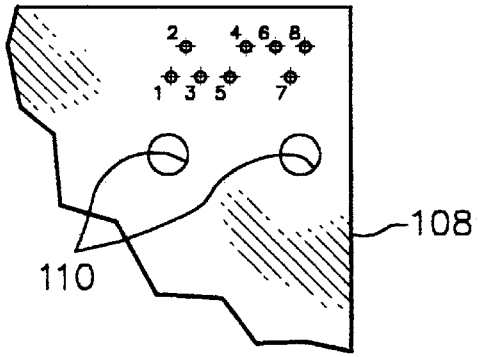
FIG. 4 is a partially broken away view of a circuit board showing mounting openings for the modular jack.
Figure 5:
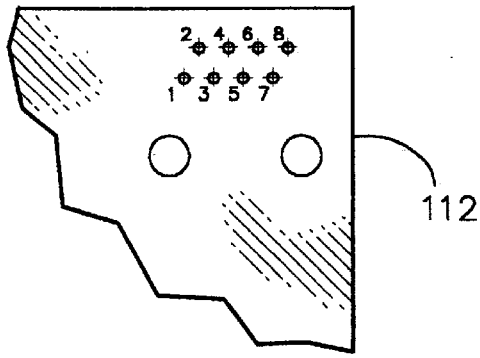
PRIOR ART FIG. 5
FIG. 5 is a view similar to FIG. 4 showing a circuit board showing mounting openings for a conventional modular jack.

FIG. 4 illustrates circuit board 108 for mounting modular jack 10. The jack is mounted on the board by positioning latches 92 over latch holes 110 and moving the jack toward the board to extend the pins into numbered pin holes 1–8. The arrangement of pin holes 1–8 on board 108 corresponds to the positions of the pins extending from the jack as shown in FIG. 3.

The arrangement of pin holes 1–8 on board 108 differs from the arrangement of pin holes 1–8 on prior art circuit board 112 used to mount a conventional modular jack where the wire contacts are not spread apart between the side walls as in the present invention and the intermediate portions of the center two wire contacts 22, 24 do not cross each other to reverse the positions of the pins for the center wire contacts.

In modular jack 10 the wire contact pins are arranged in two rows 104 and 106. As illustrated in FIG. 3, these rows are straight and parallel each other. The corresponding pin holes formed in circuit board 108 of FIG. 4 are also arranged in two straight and parallel rows. However, the invention is not limited to wire contact pins and pin holes which are arranged in straight rows or in spaced, parallel rows. The pins, and corresponding pin holes, may be arranged in non-straight rows, and the rows need not parallel each other.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A high speed, low cross talk modular jack including a body formed from dielectric material, said body defining a plug recess and including a bottom wall, opposed side walls and a contact support member extending above the bottom wall and along one side of the plug recess; and a plurality of wire contacts in the body, each wire contact including a cantilever end at the top of the support member and extending into the plug recess, a pin extending below the bottom wall and an intermediate portion joining the cantilever end and the pin, adjacent cantilever ends spaced apart a distance X along the support member, said pins being arranged in two spaced, staggered rows with each row including two adjacent pins spaced apart a distance Y and an end pin spaced from one of the adjacent pins a distance Z, the distance X being less that the distance Y and the distance Y being less than the distance Z, said end pins being located adjacent said opposite side walls, said adjacent pins in one row being located between the end pin and the nearest adjacent pin in the other row.

2. The modular jack as in claim 1 wherein the adjacent pins in the other row being located between the end pin and the nearest adjacent pin in said one row.

3. The modular jack as in claim 1 wherein the body includes a rear wall and said rows are located between the rear wall and the plug recess.

4. The modular jack as in claim 3 wherein the support member defines a plurality of contact passages extending from the bottom wall to the top of the support member, said each intermediate portion extending through one of said contact passages.

5. The modular jack as in claim 4 wherein each passage includes a large opening at the top of the support member and a smaller opening at the bottom of the support member, the wire contact in the passage having a sliding fit in the smaller opening, each passage each angled toward one of said side walls.

6. The modular jack as in claim 1 wherein each row includes three adjacent pins and an end pin.

7. The modular jack as in claim 6 where X equals 0.040 inches, Y equals 0.100 inches, Z equals 0.200 inches and said rows are spaced apart a distance equal to 0.100 inches.

8. The modular jack as in claim 7 wherein said plurality of wire contacts consist of eight wire contacts.

9. The modular jack as in claim 1 wherein the intermediate portions of two adjacent wire contacts cross over each other to reverse the positions of the pins of such wire contacts in the rows.

10. The modular jack as in claim 9 wherein the intermediate portions of said two adjacent wire contacts are located in the center of the support member and the remaining intermediate portions do not cross over each other.

11. The modular jack as in claim 1 wherein said intermediate portions do not parallel each other.

12. A connection system including a modular jack as in claim 1 and a circuit board, said circuit board including a plurality of spaced, staggered holes arranged in two rows in the pattern of said pins extending from the bottom wall of the body, electrical traces forming electrical connections with said holes, said modular jack mounted on said circuit board with said bottom wall overlying the circuit board and said pins located in said holes, and including electrical connections between said pins and said traces.

13. The modular jack as in claim 1 wherein each of said two rows is straight.

14. The modular jack as in claim 1 wherein said two spaced rows parallel each other.

15. A high speed, low cross talk modular jack including a body formed from dielectric material, said body having a bottom wall for mounting the jack on a circuit member and a plug recess; and a plurality of wire contacts in the body, each wire contact including an end extending into the plug recess, a pin extending outwardly of the bottom surface of the body and an intermediate portion joining the end and the pin, said ends spaced across one side of the plug recess for engagement with contacts on a plug inserted into the recess, adjacent wire contact ends being spaced apart a distance X, said pins arranged in two spaced, staggered rows with each row of pins including at least two adjacent pins spaced apart a distance Y and an end pin spaced from the nearest adjacent pin a distance Z, said end pins being located on opposite ends of said rows; said distance X being less than said distance Y and said distance Y being less than said distance Z, the intermediate portions of a central pair of wire contacts crossing over each other to reverse the positions of the pins for such wire contacts in said rows, and the intermediate portions of adjacent wire contacts not paralleling each other.

16. The modular jack as in claim 15 wherein said plurality of wire contacts consist of eight wire contacts and each row of pins includes three adjacent pins spaced apart said distance Y.

17. The modular jack as in claim 16 wherein said rows are spaced apart said distance Y.

18. The modular jack as in claim 17 wherein said distance X is 0.040 inches, said distance Y is 0.100 inches and said distance Z is 0.200 inches.

19. A low cross talk electrical interconnection system including a modular jack having a body formed from dielectric material, said body having a bottom wall for mounting the jack on a circuit board, a plug recess and a plurality of wire contacts in the body, each wire contact including a cantilever end located in the plug recess and a pin extending outwardly from the bottom wall of the body; and a circuit board including conductive traces, and two spaced, staggered rows of pin holes, each row including two adjacent holes spaced apart a first distance and an end hole spaced from the nearest adjacent hole a second distance, said first distance being less than said second distance, said end holes being located on opposite ends of the rows, the adjacent holes in each row being located between the end hole and the adjacent hole nearest the end hole in the other row, said pins being located in said pin holes, and electrical connections between the pins and the conductive traces in the circuit board.

20. The system as in claim 19 wherein said wire contacts each include an intermediate portion extending from a pin to a cantilever end and the intermediate portions of two wire contacts cross over each other to reverse the positions of the pin contacts for such wire contacts in said rows, the intermediate portions of adjacent wire contacts not paralleling each other.

21. The system as in claim 20 consisting of four pin holes in each row of pin holes, each row of pin holes including three adjacent pin holes spaced apart said first distance, and wherein the rows are spaced apart said first distance.

22. The system as in claim 21 wherein said first distance is 0.100 inches and said second distance is 0.200 inches and wherein said cantilever ends are spaced apart along plug recess a third distance equal to 0.040 inches.

23. The system as in claim 19 wherein said rows of pin holes are parallel.

24. The system as in claim 19 wherein each row of pin holes is straight.

* * * * *